US005220321A

United States Patent [19]

Sauer

[11] Patent Number: 5,220,321

[45] Date of Patent: Jun. 15, 1993

[54] METHOD FOR THE PROVISION OF MALFUNCTION PROTECTION FOR LIGHTS IN DECENTRALIZED TRAFFIC-LIGHT INSTALLATIONS

[75] Inventor: Werner Sauer, München, Fed. Rep. of Germany

[73] Assignee: Siemens Aktiengesellschaft, Munich, Fed. Rep. of Germany

[21] Appl. No.: 721,423

[22] PCT Filed: Jan. 25, 1990

[86] PCT No.: PCT/DE90/00045

§ 371 Date: Jul. 1, 1991

§ 102(e) Date: Jul. 1, 1991

[87] PCT Pub. No.: WO90/12381

PCT Pub. Date: Oct. 18, 1990

[30] Foreign Application Priority Data

Apr. 4, 1989 [DE] Fed. Rep. of Germany ..... 3910864

[51] Int. Cl.[5] ..... G08G 1/097

[52] U.S. Cl. ..... 340/931; 340/642; 364/436

[58] Field of Search ..... 340/907, 912, 931, 641, 340/642, 644; 307/39; 364/436, 550, 550.01

[56] References Cited

U.S. PATENT DOCUMENTS 5,073,866 12/1991 Daeges ..... 340/931 X

FOREIGN PATENT DOCUMENTS

0251097A1 1/1988 European Pat. Off. .
0268060 5/1988 European Pat. Off. .
3035515C2 5/1982 Fed. Rep. of Germany .
3230761C2 2/1984 Fed. Rep. of Germany .
3428444C2 2/1986 Fed. Rep. of Germany .

*Primary Examiner*—Jin F. Ng
*Assistant Examiner*—Jeffery A. Hofsass
*Attorney, Agent, or Firm*—Hill, Steadman & Simpson

[57] ABSTRACT

Process for signalling malfunction protection in decentralised traffic-light installations having a signalling malfunction protection (SSP) and evaluation assembly (AWP) in a node control unit (KS) and having a plurality of PLS units (PLS modules M1, M2, . . . ) which each have peripheral lamp switches and sensors and a data transceiver, which together form an LMP assembly, as well as transformers and rectifiers for associated signal generators and groups of signal generators (SG) on the respective traffic-light poles (SGM1, SGM2, . . . ). The node control unit (KS) is connected to the PLS modules (M1, M2, . . . ) with a power and a data line (EDL). In addition to the customary signalling malfunction protection, the operativeness of the individual PLS modules and LMP assemblies (M1, M2, . . . ), respectively, is cyclically tested irrespective of the momentary signalling status. With each complete telegram cycle (TZ1, TZ2, . . . ), in each case one PLS module (LMP assembly) is tested with a separate test telegram (TB) by the signalling lamps (SL) of the respective PLS module (Mn) being switched off for a very brief period (e.g. 3 ms) with the first cycle, switched to red with the second cycle, to amber with the third cycle and to green with the fourth cycle, the correct acknowledgement (RM) being monitored in the signalling malfunction protection and evaluation assembly (SAB) and, when a fault occurs, the traffic-light installation being at least partially switched off or switched to flashing amber.

3 Claims, 2 Drawing Sheets

METHOD FOR THE PROVISION OF MALFUNCTION PROTECTION FOR LIGHTS IN DECENTRALIZED TRAFFIC-LIGHT INSTALLATIONS

BACKGROUND OF THE INVENTION

The present invention relates in general to a process for signalling cut-out protection in decentralised traffic-light installations.

The process according to the present invention relates to a signalling malfunction protection in decentralized traffic-light installations having a signalling cut-out protection and evaluation assembly in a node control unit and having a plurality of peripheral lamp switches and sensor, designated as a module and a data transceiver, which together form an LMP assembly, as well as transformers and rectifiers for associated signal generators and groups of signal generators on respective traffic-light poles, the node control unit being connected to the data transceivers of the individual LMP assemblies via a power and a data line.

Decentralised traffic-light installations have peripheral lamp switches and sensors which are accommodated decentrally from the actual node control unit for the respective groups of signal generators on the traffic-light pole. The components, required for this, consisting of a transformer and rectifiers as well as an LMP assembly for data transceivers and lamp switches with signalling cut-out protection sensors, so-called sensors, together form a PLS unit, also referred to as a PLS module. The associated signal groups are actuated from the cross connection unit via connecting lines and the PLS modules and LMP assemblies. The connection from the control unit to the individual modules can be formed by means of a specially produced cable (consisting of phase-protection, zero-protection conductors and a coaxial line) the control of the individual signal lamps and the acknowledgements occurring via the coaxial cable. A decentralised traffic-signalling installation is described, for example, in German Offenlegungsschrift 32 30 761.

The evaluation of the data, e.g. the signalling malfunction status of the signalling lamps takes place in a signalling malfunction protection microprocessor assembly, generally in the control unit. A monitoring device of this kind for traffic signalling installations with microprocessor assemblies is described in German Offenlegungsschrift 34 28 444.

In order to monitor the entire control unit and the associated signal generators, it is ensured, for example by means of system tests, that the entire installation is completely operative. In this process, for example every 300 milliseconds, a genuine malfunction can be generated at the signal generator for a short period, e.g. 2 ms, this conflict not being visible. The signalling malfunction protection microprocessor detects this and issues a corresponding signal. However, if it is not detected, the installation switches off (EP-A 1-0 251 097).

DE-PS 30 35 515 describes a circuit arrangement for operating signal generators of a traffic-light installation. In the known circuit arrangement, all the signalling lamps are supplied via a single power line, each signal generator or each signal generator group having peripheral lamp switches and sensors as well as associated data transceivers, which are connected to the control unit via a common data line.

SUMMARY OF THE INVENTION

Because in decentralised traffic-light installations of this kind there is no direct connection from the respective signalling lamps on the traffic-light pole to the signalling malfunction protection in the control unit, but rather only a common power line and common control line are provided for data traffic, it is the object of the invention reliably to ensure signalling malfunction protection by means of additional measures.

This object is achieved according to the invention by means of the process wherein, in addition to the customary signalling cut-out protection, the operativeness of the individual LMP modules is cyclically tested irrespective of the momentary signalling status, in each case one LMP assembly being tested with a separate test telegram with each complete telegram cycle, by the signalling lamps of the respective module being switched off for a very brief period (e.g. 3 ms) with the first cycle, switched to red with the second cycle, to amber with the third cycle and to green with the fourth cycle, the correct acknowledgement being monitored in the signalling cut-out protection and evaluation assembly and, when a fault occurs, the traffic-light installation being at least partially switched off or switched to flashing amber. In this process, the information of the voltage and current sensors are additionally tested per signal generator and signalling lamp, respectively.

With the process described at the beginning, the object is achieved in that, in addition to the customary signalling malfunction protection, the operativeness of the individual PLS modules is cyclically tested, irrespective of the momentary signalling status, in each case one LMP assembly of a PLS module being tested with a separate test telegram with each complete telegram cycle. In this case, the signalling lamps of the respective LMP assembly are switched off for a very brief period with the first cycle, switched to red with the second cycle, to amber with the third cycle and to green with the fourth cycle, the correct acknowledgement being monitored in the signalling malfunction protection and evaluation assembly and, when a fault occurs, the traffic-light installation being at least partially switched off or switched to flashing amber.

Thus, with each telegram cycle, which has for a time of 10 ms, in each case one PLS module is tested. Irrespective of the momentary signalling lamp status of the PLS module, the signalling lamps are switched off in the first run, to red in the second run etc. A complete run here can last 150 ms. The test information remains in place for approximately 3 ms and is then removed.

In an advantageous manner, the test telegram has an identifier and an item of test information, by means of which the respective LMP assembly transmits the normal information in a buffer and the test information to the associated signalling lamps. At the end of the complete telegram cycle, the normal information with test identifier, i.e. a reset telegram for the respective LMP assembly, is transmitted once more to reset the signalling lamps. If no fault occurs in this test, everything is in order. However, if a fault occurs when testing the LMP assembly, e.g. when all the lamps are off, a corresponding current sensor reports current so that the installation is at least partially switched off.

In an advantageous embodiment of the process according to the invention, every LMP assembly has a reset device which automatically transmits the stored normal information to the respective signalling lamp if the reset telegram does not occur. It is thus ensured in the LMP assembly, by hardware means, with this device that after a specific time, (e.g. approximately 8 ms) of a half wave the normal information is switched back to the signal generators.

BRIEF DESCRIPTION OF THE DRAWINGS

The feature of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
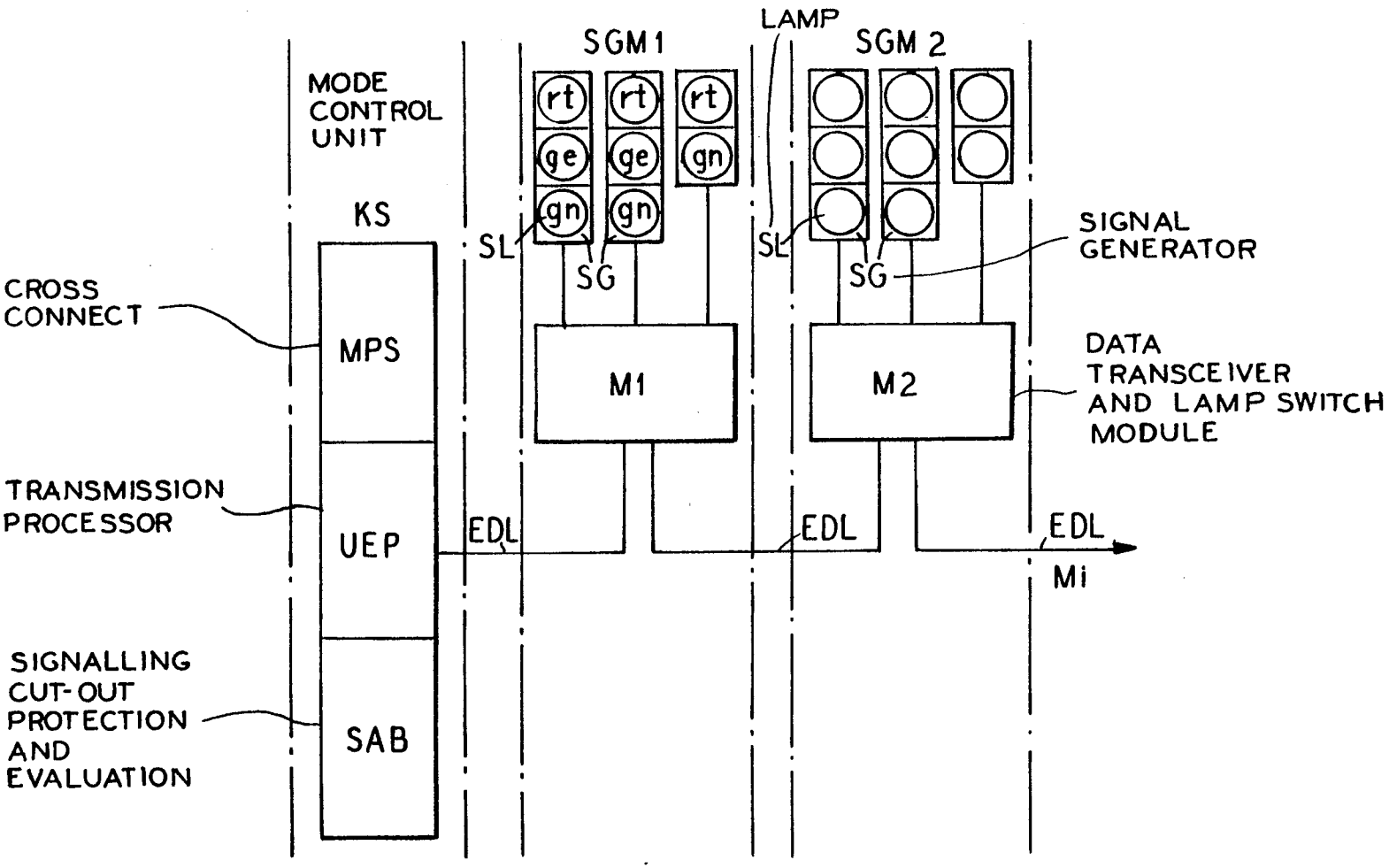
FIG. 1 shows a block circuit diagram for the process according to the invention.

In FIG. 1 a traffic-light installation is illustrated in a very simple manner. A node control unit KS is connected to the individual PLS modules M1 to Mi via a power and data line EDL. The signal generators SG with their signalling lamps SL of a traffic-light pole SGM1 are assigned to a respective PLS module (Mn). The node control unit KS has, in addition to a cross connection-specific control unit MPS and a transmission processor UEP, a signalling malfunction protection (SSP) and evaluation (AWP) assembly SAB which carries out the module test in addition to the customary signalling cut-out protection.

Figures 2A, 2B, 2C, 2D, 2E:
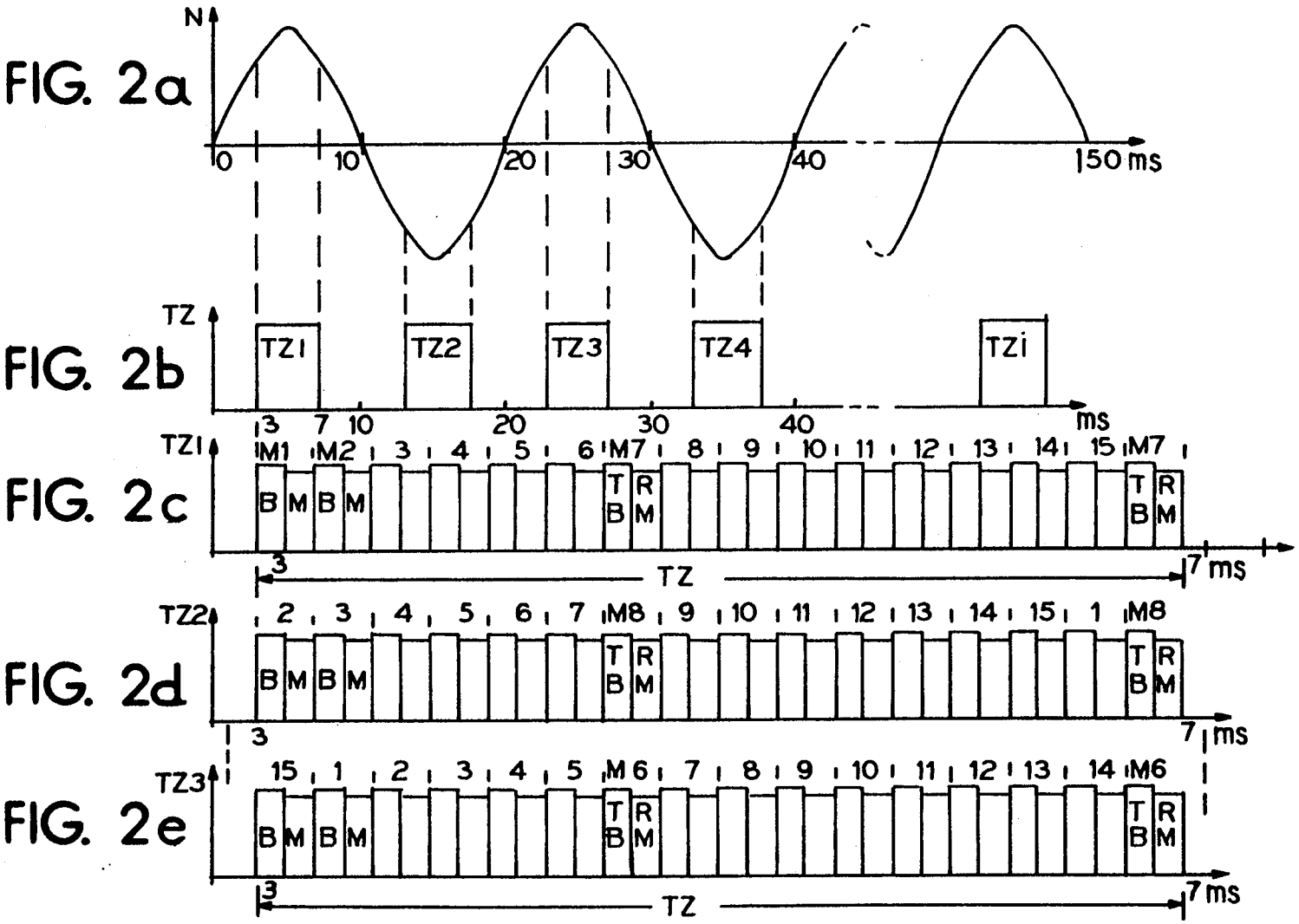
FIGS. 2*a* to 2*e* show corresponding pulse telegrams for the execution of the data traffic between the control unit and the LMP assemblies of the PLS modules.

In FIGS. 2*a* to 2*e*, the pulse telegrams corresponding to this for the execution of the data traffic are illustrated. In FIG. 2*a*, the network oscillation (N) is shown at which a complete telegram cycle TZ1 to TZi is transmitted within each half wave, as is shown under the network oscillation in FIG. 2*b* for the entire data traffic. With a complete telegram cycle TZn, all the LMP assemblies of the PLS modules (e.g. M1 to Mi) are addressed, but only a single module is tested. In this process, a complete test run can last 150 ms.

In FIG. 2*c*, a first telegram cycle TZ1 are illustrated into which a test instruction telegram TB with associated acknowledgement RM for the LMP assemblies of the PLS module M7 is additionally transmitted. Below this, in FIG. 2*d*, a second telegram cycle TZ2 is illustrated with which the LMP assembly of the PLS module M8 is tested. With a third telegram cycle, as shown in FIG. 2*e*, the LMP assembly of the PLS module M6 is tested. In this example, all the modules are tested (i=15) with 15 complete telegram cycles. A complete test run lasts 150 ms in this example.

The invention is not limited to the particular details of the method depicted and other modifications and applications are contemplated. Certain other changes may be made in the above described method without departing from the true spirit and scope of the invention herein involved. It is intended, therefore, that the subject matter in the above depiction shall be interpreted as illustrative and not in a limiting sense.

What is claimed is:

1. A method for signalling malfunction protection in decentralized traffic-light installations having a signalling malfunction protection and evaluation assembly in a node control unit and having a plurality of peripheral lamp switches and sensors that form modules, and data transceivers, which together form assemblies, as well as transformers and rectifiers for associated signal generators and groups of signal generators on respective traffic-light poles, the node control unit being connected to the data transceivers of the individual assemblies via a power and a data line, comprising the steps of: cyclically testing, in addition to signalling malfunction protection, the operativeness of individual assemblies irrespective of momentary signalling status, in each case one assembly being tested with a separate test telegram with a complete telegram cycle that addresses all assemblies, by signalling lamps of the respective module being switched off for a very brief period with a first cycle, switched to red with a second cycle, switched to amber with a third cycle and switched to green with a fourth cycle, a correct acknowledgement being monitored in the signalling malfunction protection and evaluation assembly and, when a fault occurs, the traffic light installation being at least partially switched off or switched to flashing amber.

2. The method according to claim 1, wherein the test telegram has an identifier and an item of test information, normal information for the respective assembly being transmitted into a buffer in the respective assembly and the test information being transmitted to the associated signalling lamps, and wherein at the end of all telegram cycles the normal information with test identifier, in a reset telegram, for the respective assembly is transmitted once more.

3. The method according to claim 2, wherein every assembly has a reset device which automatically transmits the normal information stored in the respective buffer of every assembly to the respective signalling lamps if the reset telegram does not occur.

* * * * *